US010060191B2

(12) United States Patent
Olsen

(10) Patent No.: US 10,060,191 B2
(45) **Date of Patent: *Aug. 28, 2018**

(54) CONTINUOUS FIBER-REINFORCED TOOLS FOR DOWNHOLE USE

(71) Applicant: Halliburton Energy Services, Inc., Houston, TX (US)

(72) Inventor: Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 496 days.

This patent is subject to a terminal disclaimer.

(21) Appl. No.: 14/650,003

(22) PCT Filed: Jul. 3, 2014

(86) PCT No.: PCT/US2014/045352

§ 371 (c)(1),
(2) Date: Jun. 5, 2015

(87) PCT Pub. No.: WO2016/003464

PCT Pub. Date: Jan. 7, 2016

(65) Prior Publication Data

US 2016/0281438 A1 Sep. 29, 2016

(51) Int. Cl.
*E21B 10/00* (2006.01)
*E21B 10/54* (2006.01)
(Continued)

(52) U.S. Cl.
CPC ..... *E21B 10/54* (2013.01); *E21B 7/06* (2013.01); *E21B 10/02* (2013.01); *E21B 10/08* (2013.01);
(Continued)

(58) Field of Classification Search
CPC . E21B 10/54; E21B 7/06; E21B 10/02; E21B 10/08; E21B 10/26; E21B 10/42;
(Continued)

(56) References Cited

U.S. PATENT DOCUMENTS 3,895,162 A * 7/1975 Lemont ..... B29C 70/12 428/608
4,548,280 A * 10/1985 Daly ..... E21B 10/24 175/228

(Continued)

FOREIGN PATENT DOCUMENTS

WO 9908033 A1 2/1999
WO 2010075168 A2 7/2010
WO 2016003464 A1 1/2016

OTHER PUBLICATIONS

International Search Report and Written Opinion for PCT/US2014/045352 dated Mar. 31, 2015.

*Primary Examiner* — Taras P Bemko
(74) *Attorney, Agent, or Firm* — McDermott Will & Emery LLP

(57) ABSTRACT

Continuous fiber-reinforced hard composites may be useful in mitigating crack propagation in downhole tools. In some instances, a wellbore tool may be formed at least in part by a continuous fiber-reinforced hard composite portion. The continuous fiber-reinforced hard composite portion includes a binder material continuous phase with reinforcing particles and continuous fibers contained therein, wherein the continuous fibers have an aspect ratio at least 15 times greater than a critical aspect ratio (Ac). The critical aspect ratio can be determined using the equation $Ac=\sigma f/(2\tau c)$, $\sigma f$ is an ultimate tensile strength of the continuous fibers, and $\tau C$ is a lower of (1) an interfacial shear bond strength between the continuous fibers and the binder material and (2) a yield stress of the binder material.

18 Claims, 9 Drawing Sheets

(51) Int. Cl.

| | |
|---|---|
| ***E21B 10/42*** | (2006.01) |
| ***E21B 7/06*** | (2006.01) |
| ***E21B 10/02*** | (2006.01) |
| ***E21B 10/08*** | (2006.01) |
| ***E21B 10/26*** | (2006.01) |
| ***E21B 10/61*** | (2006.01) |
| ***E21B 17/10*** | (2006.01) |
| ***E21B 33/12*** | (2006.01) |
| *E21B 10/55* | (2006.01) |

(52) U.S. Cl.
CPC ..... *E21B 10/26* (2013.01); *E21B 10/42* (2013.01); *E21B 10/61* (2013.01); *E21B 17/1078* (2013.01); *E21B 33/12* (2013.01); *E21B 10/55* (2013.01)

(58) Field of Classification Search
CPC ..... E21B 10/61; E21B 17/1078; E21B 33/12; E21B 10/55
USPC ..... 175/374, 393
See application file for complete search history.

(56) References Cited

U.S. PATENT DOCUMENTS

| | | | | |
|---|---|---|---|---|
| 7,695,542 | B2 | 4/2010 | Drivdahl et al. | |
| 7,975,785 | B2 | 7/2011 | Drivdahl et al. | |
| 2008/0128170 | A1 | 6/2008 | Drivdahl et al. | |
| 2008/0209818 | A1 | 9/2008 | Belnap et al. | |
| 2009/0078469 | A1* | 3/2009 | Drivdahl ..... | E21B 10/48 175/374 |
| 2010/0263935 | A1 | 10/2010 | Smith et al. | |
| 2013/0000982 | A1 | 1/2013 | Olsen | |

* cited by examiner

CONTINUOUS FIBER-REINFORCED TOOLS FOR DOWNHOLE USE

BACKGROUND

The present disclosure relates to reinforced tools for downhole use along with associated methods of production and use related thereto.

A wide variety of tools are used downhole in the oil and gas industry, including tools for forming wellbores, tools used in completing wellbores that have been drilled, and tools used in producing hydrocarbons such as oil and gas from the completed wellbores. Cutting tools, in particular, are frequently used to drill oil and gas wells, geothermal wells and water wells. Cutting tools may include roller cone drill bits, fixed cutter drill bits, reamers, coring bits, and the like. For example, fixed cutter drill bits are often formed with a composite bit body (sometimes referred to in the industry as a matrix bit body), having cutting elements or inserts disposed at select locations about the exterior of the matrix bit body. During drilling, these cutting elements engage and remove adjacent portions of the subterranean formation.

Composite materials used in a matrix bit body of a fixed-cutter bit are generally erosion-resistant and exhibit high impact strength. However, some composite materials can be relatively brittle compared to other bit body materials. As a result, stress cracks can occur in the matrix bit body because of the thermal stresses experienced during manufacturing or the mechanical stresses conveyed during drilling. This is especially true as erosion of the composite materials accelerates.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
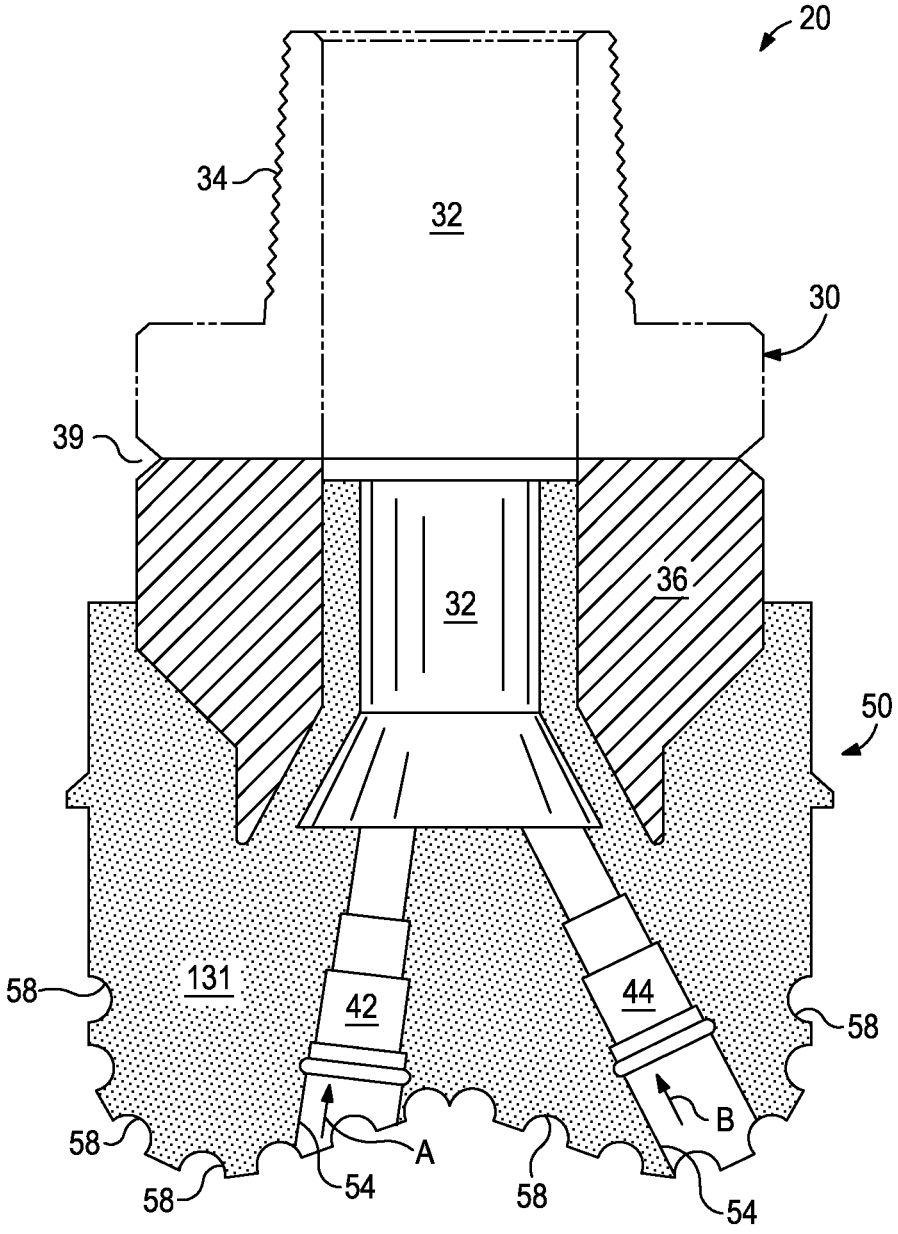
FIG. 1 is a cross-sectional view showing one example of a drill bit having a matrix bit body with at least one continuous fiber-reinforced portion in accordance with the teachings of the present disclosure.

The present disclosure relates to continuous fiber-reinforced downhole tools, and methods of manufacturing and using such continuous fiber-reinforced downhole tools. The teachings of this disclosure can be applied to any downhole tool that can be formed at least partially of composite materials and which experiences wear during contact with a borehole or other downhole devices. Such tools may include tools for drilling wells, completing wells, and producing hydrocarbons from wells. Examples of such tools include, but are not limited to, cutting tools, such as drill bits, reamers, stabilizers, and coring bits; drilling tools such as rotary steerable devices, mud motors; and other tools used downhole such as window mills, packers, tool joints, and other wear-prone tools.

By way of example, several embodiments described herein pertain more particularly to a drill bit having a matrix bit body with at least one s portion formed by a binder material continuous phase with reinforcing particles (e.g., carbide powders) and continuous fibers contained therein (alternatively referred to as "continuous fiber-reinforced hard composite portions"). These are distinguishable from other types of hard composite portions that do not contain continuous fibers.

As used herein, the term "continuous fiber" refers to a fiber having an aspect ratio (length/diameter) 15 times or more greater than a critical aspect ratio ($A_c$), wherein $A_c=\sigma_f/(2\tau_c$, $\sigma_f$ is an ultimate tensile strength of the continuous fibers, and $\tau_c$ is the lesser of (1) an interfacial shear bond strength between the continuous fiber and the binder material and (2) a yield stress of the binder material. As used herein the term "fiber" encompasses fibers, whiskers, rods, wires, dog bones, ribbons, discs, wafers, flakes, rings, and the like, and hybrids thereof. As used herein, the term "dog bone" refers to an elongated structure like a fiber, whisker, or rod where the cross-sectional area at or near the ends of the structure are greater than a cross-sectional area therebetween. As used herein, the aspect ratio of a 2-dimensional structure (e.g., ribbons, discs, wafers, flakes, or rings) refers to the ratio of the longest dimension to the thickness.

In some embodiments, the continuous fibers may have cross-sectional shapes that include circular, ovular, polygonal (e.g., triangle, square, rectangle, etc.), and the like, and any hybrid thereof.

In some embodiments, a continuous fiber may be arranged to form a 3-dimensional structure (e.g., a coil).

In some embodiments, a collection of continuous fibers may be arranged to form a 2-dimensional or 3-dimensional structure (e.g., an oriented wool, a disoriented wool, or a mesh). As used herein, the term "oriented wool" refers to an entangled mass of continuous fibers where at least 90% of the continuous fibers are oriented within 25° of each other (e.g., steel wool), which may be a result of the manufacturing process, entanglement method, or an orienting process (e.g., stretching a disoriented wool). As used herein, the term "disoriented wool" is an entangled mass of continuous fibers that are less oriented than an oriented wool. As used herein, the term "wool" encompasses both oriented wools and disoriented wools.

Without being limited by theory, it is believed that the continuous fibers, due at least in part to their composition and aspect ratio, will reinforce the surrounding composite material to resist crack initiation and propagation through the continuous fiber-reinforced hard composite portion of the wellbore tool, or a portion thereof. Mitigating crack initiation and propagation may reduce the scrap rate during production and increase the lifetime of the wellbore tools once in use.

In some embodiments, the continuous fibers described herein may have an aspect ratio of 25 or greater. In other embodiments, the continuous fibers described herein may have an aspect ratio of 100 or greater. In some embodiments, the continuous fibers described herein may have an aspect ratio ranging from a lower limit of 10, 50, 100, or 250 to an upper limit of 2000, 1000, 500, 250, 100, 50, or 25, wherein the aspect ratio of the continuous fibers may range from any lower limit to any upper limit and encompasses any subset therebetween. One of skill in the art would readily recognize that continuous fibers may have an aspect ratio outside this range. For example, a continuous fiber may be a spool of wire organized in a coil about a flow passageway for a nozzle (illustrated in FIG. 1) where the continuous fiber is 50 microns in diameter and 8000 m in length, which provides for a 160 million aspect ratio.

In some embodiments, two or more continuous fibers that differ at least in aspect ratio may be used in continuous fiber-reinforced hard composite portions described herein.

In some embodiments, the continuous fibers described herein may have a diameter ranging from a lower limit of 1 micron, 10 microns, or 25 microns to an upper limit of 3 mm, 1 mm, 500 microns, 250 microns, 100 microns, or 50 microns, wherein the diameter of the continuous fibers may range from any lower limit to any upper limit and encompasses any subset therebetween. One skilled in the art would recognize that the length of the continuous fibers will depend on the diameter of the continuous fibers and the critical aspect ratio of the continuous fibers relative to the binder material in which the continuous fibers are implemented and the composition of the continuous fibers. In some embodiments, two or more continuous fibers that differ at least in diameter may be used in continuous fiber-reinforced hard composite portions described herein. As used herein, the term "diameter" refers to the smallest cross-sectional diameter of the continuous fiber. Therefore, a ribbon-shaped continuous fiber's diameter would be the thickness of the ribbon.

In some embodiments, the continuous fibers described herein may be 2-dimensional structures like ribbons with a width to thickness (diameter) ratio ranging from a lower limit of 2, 5, 10, 50, 100, or 250 to an upper limit of 500, 250, 100, 50, or 25, wherein the diameter of the continuous fibers may range from any lower limit to any upper limit and encompasses any subset therebetween. In some embodiments, two or more continuous fibers that differ at least in thickness to width ratio may be used in continuous fiber-reinforced hard composite portions described herein.

The continuous fibers described herein may preferably have a composition that bonds with the binder material, so that an increased amount of thermal and mechanic stresses (or loads) can be transferred to the fibers. Further, a composition that bonds with the binder material may be less likely to pull out from the binder material as a crack potentially propagates.

Additionally, as described in more detail below, the composition of the continuous fibers may preferably endure temperatures and pressures experienced when forming a continuous fiber-reinforced hard composite portion with little to no alloying with the binder material or oxidation. However, in some instances, the atmospheric conditions may be changed (e.g., reduced oxygen content achieved via reduced pressures or gas purge) to mitigate oxidation of the continuous fibers to allow for a composition that may not be suitable for use in standard atmospheric oxygen concentrations.

In some embodiments, the composition of the continuous fibers may have a melting point greater than the melting point of the binder material (e.g., greater than 1000° C.). In some embodiments, the composition of the continuous fibers may have a melting point ranging from a lower limit of 1000° C., 1250° C., 1500° C., or 2000° C. to an upper limit of 3800° C., 3500° C., 3000° C., or 2500° C., wherein the melting point of the composition may range from any lower limit to any upper limit and encompasses any subset therebetween.

In some embodiments, the composition of the continuous fibers may have an oxidation temperature for the given atmospheric conditions that is greater than the melting point of the binder material (e.g., greater than 1000° C.). In some embodiments, the composition of the continuous fibers may have an oxidation temperature for the given atmospheric conditions ranging from a lower limit of 1000° C., 1250° C., 1500° C., or 2000° C. to an upper limit of 3800° C., 3500° C., 3000° C., or 2500° C., wherein the oxidation temperature of the composition may range from any lower limit to any upper limit and encompasses any subset therebetween.

Examples of compositions of the continuous fibers for use in conjunction with the embodiments described herein may include, but are not limited to, tungsten, molybdenum, niobium, tantalum, rhenium, titanium, chromium, steels, stainless steels, austenitic steels, ferritic steels, martensitic steels, precipitation-hardening steels, duplex stainless steels, iron alloys, nickel alloys, chromium alloys, carbon, refractory ceramic, silicon carbide, silicon nitride, silica, alumina, titania, mullite, zirconia, boron nitride, titanium carbide, titanium nitride, boron nitride, and the like, and any combination thereof. In some embodiments, two or more continuous fibers that differ at least in composition may be used in continuous fiber-reinforced hard composite portions described herein.

In some embodiments, a continuous fiber-reinforced hard composite portion described herein may include continuous fibers at a concentration ranging from a lower limit of 0.01%, 0.05%, 0.1%, 0.5%, 1%, 3%, or 5% by weight of the reinforcing particles to an upper limit of 30%, 20%, or 10% by weight of the reinforcing particles, wherein the concentration of continuous fibers may range from any lower limit to any upper limit and encompasses any subset therebetween.

Examples of binder materials suitable for use in conjunction with the embodiments described herein may include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of binder materials may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially available binder materials may include, but are not limited to, VIRGIN™ Binder material 453D (copper-manganese-nickel-zinc, available from Belmont Metals, Inc.); copper-tin-manganese-nickel and copper-tin-manganese-nickel-iron grades 516, 519, 523, 512, 518, and 520 available from ATI Firth Sterling; and any combination thereof.

While the composition of some of the continuous fibers and binder materials may overlap, one skilled in the art would recognize that the composition of continuous fibers should be chosen to have a melting point greater than the continuous fiber-reinforced hard composite production temperature, which is at or higher than the melting point of the binder material.

In some instances, reinforcing particles suitable for use in conjunction with the embodiments described herein may include particles of metals, metal alloys, metal carbides, metal nitrides, diamonds, superalloys, and the like, or any combination thereof. Examples of reinforcing particles suitable for use in conjunction with the embodiments described herein may include particles that include, but not be limited to, nitrides, silicon nitrides, boron nitrides, cubic boron nitrides, natural diamonds, synthetic diamonds, cemented carbide, spherical carbides, low alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, chromium alloys, HASTELLOY® alloys (nickel-chromium containing alloys, available from Haynes International), INCONEL® alloys (austenitic nickel-chromium containing superalloys, available from Special Metals Corporation), WASPALOYS® (austenitic nickel-based superalloys), RENE® alloys (nickel-chrome containing alloys, available from Altemp Alloys, Inc.), HAYNES® alloys (nickel-chromium containing superalloys, available from Haynes International), INCOLOY® alloys (iron-nickel containing superalloys, available from Mega Mex), MP98T (a nickel-copper-chromium superalloy, available from SPS Technologies), TMS alloys, CMSX® alloys (nickel-based superalloys, available from C-M Group), N-155 alloys, any mixture thereof, and any combination thereof. In some embodiments, the reinforcing particles may be coated. By way of nonlimiting example, the reinforcing particles may include diamond coated with titanium.

In some embodiments, the reinforcing particles described herein may have a diameter ranging from a lower limit of 1 micron, 10 microns, 50 microns, or 100 microns to an upper limit of 3000 microns, 2000 microns, 1000 microns, 800 microns, 500 microns, 400 microns, or 200 microns, wherein the diameter of the reinforcing particles may range from any lower limit to any upper limit and encompasses any subset therebetween.

By way of nonlimiting example, FIGS. 1-8 provide examples of implementing continuous fiber-reinforced hard composites described herein in matrix drill bits. One skilled in the art will recognize how to adapt these teachings to other wellbore tools, including all those mentioned herein, or portions thereof.

FIG. 1 is a cross-sectional view showing one example of a matrix drill bit 20 formed with a matrix bit body 50 that has a continuous fiber-reinforced hard composite portion 131 with continuous fibers and reinforcing particles contained in a continuous binder phase. As used herein, the term "matrix drill bit" encompasses rotary drag bits, drag bits, fixed cutter drill bits, and any other drill bits having a matrix bit body capable of incorporating the teachings of the present disclosure.

For embodiments such as shown in FIG. 1, the matrix drill bit 20 may include a metal shank 30 with a metal blank 36 securely attached thereto (e.g., at weld location 39). The metal blank 36 extends into the matrix bit body 50. The metal shank 30 has a threaded connection 34 distal to the metal blank 36.

The metal shank 30 and metal blank 36 are generally cylindrical structures that at least partially define corresponding fluid cavities 32 that fluidly communicate with each other. The fluid cavity 32 of the metal blank 36 may further extend into the matrix bit body 50. At least one flow passageway (shown as two flow passageways 42 and 44) may extend from the fluid cavity 32 to the exterior portions of the matrix bit body 50. Nozzle openings 54 may be defined at the ends of the flow passageways 42 and 44 at the exterior portions of the matrix bit body 50.

Figure 2:
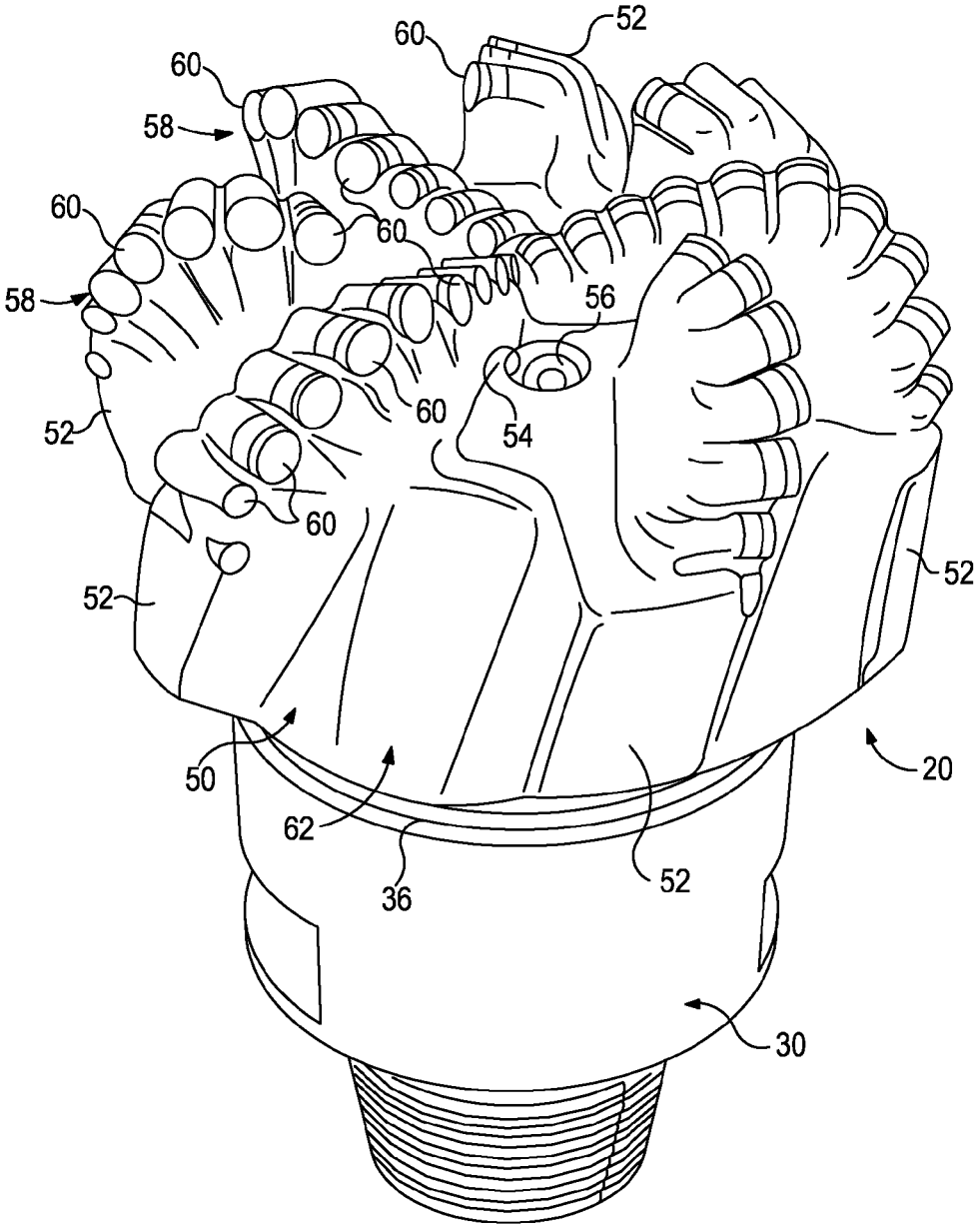
FIG. 2 is an isometric view of the drill bit of FIG. 1.

A plurality of indentations or pockets 58 are formed at the exterior portions of the matrix bit body 50 and are shaped to receive corresponding cutting elements (shown in FIG. 2).

Regarding crack propagation in a matrix bit body 50, in some instances, cracks may originate at or near the nozzle openings 54 and propagate up flow passageways 42 and 44 in the direction of arrows A and B, respectively. As described further herein, the stress (or load) of the fracture may transfer to the continuous fibers and mitigate crack propagation. Therefore, continuous fibers non-parallel to the crack propagation direction provide some degree of load transfer and mitigation of crack propagation. In some instances, the continuous fibers (or a portion thereof) are aligned substantially perpendicular (e.g., within 25° of perpendicular) to the crack propagation direction to maximize stress transfer and minimize crack propagation.

FIG. 2 is an isometric view showing one example of a matrix drill bit 20 formed with the matrix bit body 50 formed by a continuous fiber-reinforced hard composite portion in accordance with the teachings of the present disclosure. As illustrated, the matrix drill bit 20 includes the metal blank 36 and the metal shank 30, as generally described above with reference to FIG. 1.

The matrix bit body 50 includes a plurality of cutter blades 52 formed on the exterior of the matrix bit body 50. Cutter blades 52 may be spaced from each other on the exterior of the composite matrix bit body 50 to form fluid flow paths or junk slots 62 therebetween.

As illustrated, the plurality of pockets 58 formed in the cutter blades 52 at selected locations receive corresponding cutting elements 60 (also known as cutting inserts), securely mounted (e.g., via brazing) in positions oriented to engage and remove adjacent portions of a subterranean formation during drilling operations. More particularly, the cutting elements 60 may scrape and gouge formation materials from the bottom and sides of a wellbore during rotation of the matrix drill bit 20 by an attached drill string (not shown). For some applications, various types of polycrystalline diamond compact (PDC) cutters may be used as cutting elements 60.

A matrix drill bit having such PDC cutters may sometimes be referred to as a "PDC bit".

A nozzle 56 may be disposed in each nozzle opening 54. For some applications, nozzles 56 may be described or otherwise characterized as "interchangeable" nozzles.

Regarding crack propagation in a matrix bit body 50, in some instances, cracks may develop in the blades 52 from any direction due to impact and torque experienced during drilling. Because the cracks may originate from all directions, continuous fibers arranged in a disoriented structure or dispersed with minimal orientation may be preferably used to reinforce the blades 52.

A wide variety of molds may be used to form a composite matrix bit body and associated matrix drill bit in accordance with the teachings of the present disclosure.

Figure 3:
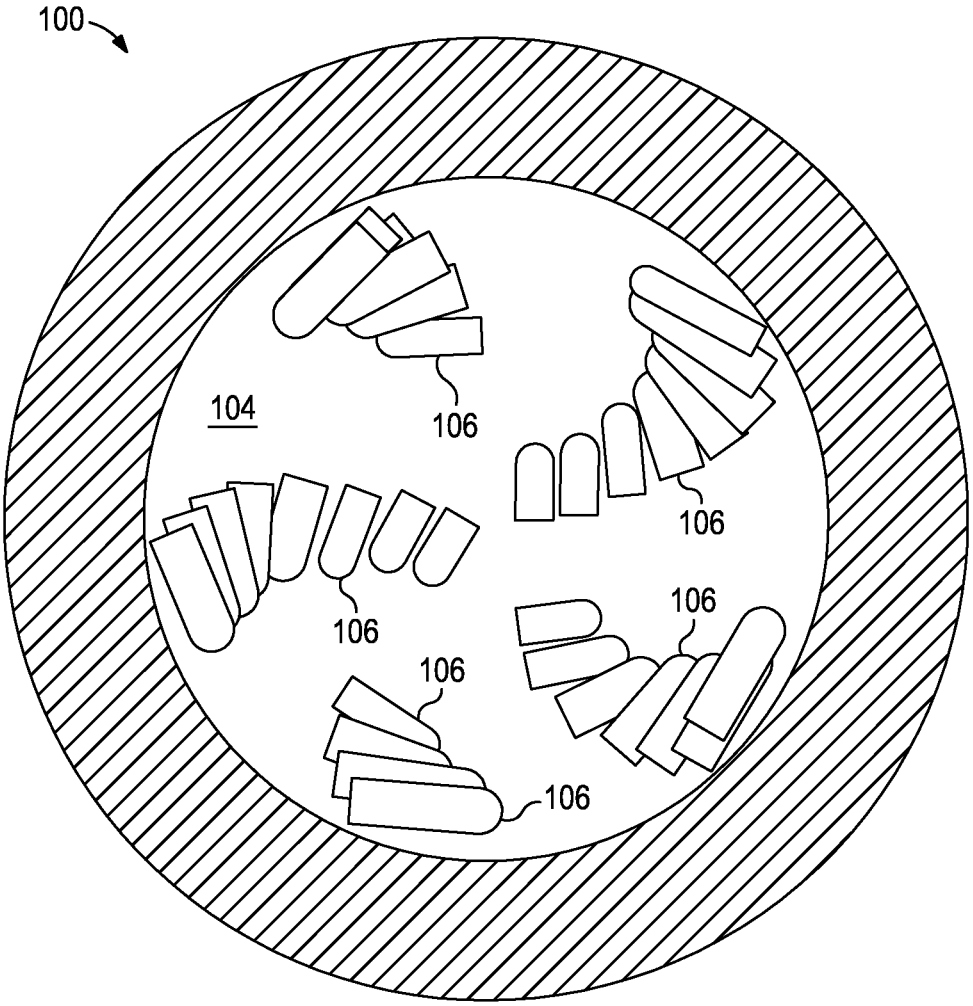
FIG. 3 is an end view showing one example of a mold assembly for use in forming a matrix bit body in accordance with the teachings of the present disclosure.

FIG. 3 is an end view showing one example of a mold assembly 100 for use in forming a matrix bit body incorporating teachings of the present disclosure. A plurality of mold inserts 106 may be placed within a cavity 104 defined by or otherwise provided within the mold assembly 100. The mold inserts 106 may be used to form the respective pockets in blades of the matrix bit body. The location of mold inserts 106 in cavity 104 corresponds with desired locations for installing the cutting elements in the associated blades. Mold inserts 106 may be formed from various types of material such as, but not limited to, consolidated sand and graphite.

Figure 4:
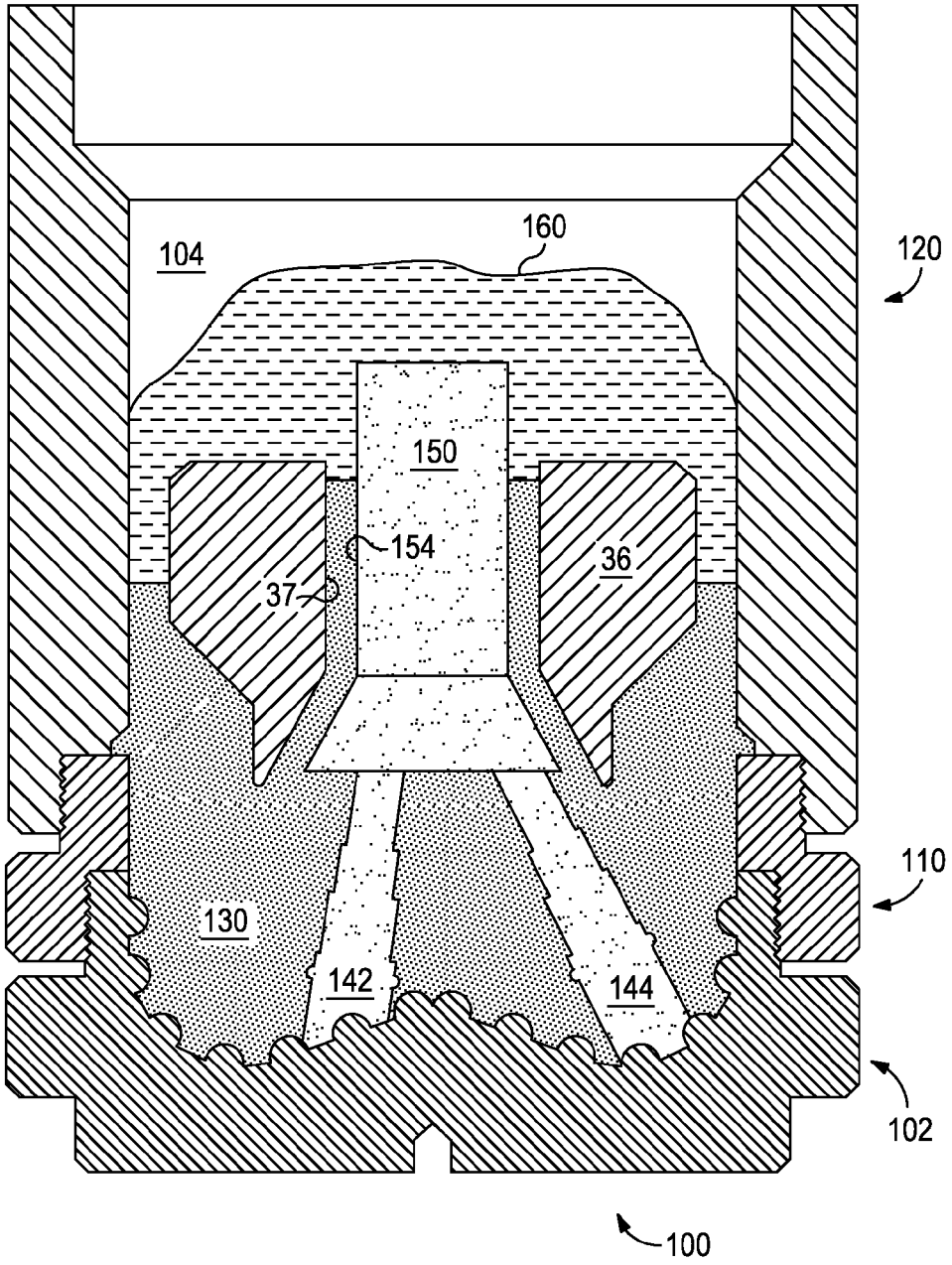
FIG. 4 is a cross-sectional view showing one example of a mold assembly for use in forming a matrix bit body in accordance with the teachings of the present disclosure.

FIG. 4 is a cross-sectional view of the mold assembly 100 of FIG. 3 that may be used in forming a matrix bit body incorporating teachings of the present disclosure. The mold assembly 100 may include several components such as a mold 102, a gauge ring or connector ring 110, and a funnel 120. Mold 102, gauge ring 110, and funnel 120 may be formed from graphite or other suitable materials known to those skilled in the art. Various techniques may be used to manufacture the mold assembly 100 and components thereof including, but not limited to, machining a graphite blank to produce the mold 102 with the associated cavity 104 having a negative profile or a reverse profile of desired exterior features for a resulting matrix bit body. For example, the cavity 104 may have a negative profile that corresponds with the exterior profile or configuration of the blades 52 and the junk slots 62 formed therebetween, as shown in FIGS. 1-2.

Various types of temporary displacement materials may be installed within mold cavity 104, depending upon the desired configuration of a resulting matrix drill bit. Additional mold inserts (not expressly shown) may be formed from various materials (e.g., consolidated sand and/or graphite) may be disposed within mold cavity 104. Such mold inserts may have configurations corresponding to the desired exterior features of the matrix drill bit (e.g., junk slots).

Displacement materials (e.g., consolidated sand) may be installed within the mold assembly 100 at desired locations to form the desired exterior features of the matrix drill bit (e.g., the fluid cavity and the flow passageways). Such displacement materials may have various configurations. For example, the orientation and configuration of the consolidated sand legs 142 and 144 may be selected to correspond with desired locations and configurations of associated flow passageways and their respective nozzle openings. The consolidated sand legs 142 and 144 may be coupled to threaded receptacles (not expressly shown) for forming the threads of the nozzle openings that couple the respective nozzles thereto.

A relatively large, generally cylindrically-shaped consolidated sand core 150 may be placed on the legs 142 and 144. Core 150 and legs 142 and 144 may be sometimes described as having the shape of a "crow's foot." Core 150 may also be referred to as a "stalk." The number of legs 142 and 144 extending from core 150 will depend upon the desired number of flow passageways and corresponding nozzle openings in a resulting matrix bit body. The legs 142 and 144 and the core 150 may also be formed from graphite or other suitable materials.

After desired displacement materials, including core 150 and legs 142 and 144, have been installed within the mold assembly 100, the reinforcing material 130 (i.e., the reinforcing particles, the continuous fibers, and combinations thereof) may then be placed within or otherwise introduced into the mold assembly 100.

In some embodiments, the continuous fibers described herein may be loose fibers that are mixed with the reinforcing particles to form the reinforcing material 130. In other embodiments, however, the a portion of the reinforcing material 130 may include the reinforcing particles and not include the continuous fibers for forming hard composite portions that are not continuous fiber-reinforced. As described further herein, different compositions of reinforcing material 130 may be used to achieve a continuous fiber-reinforced bit body having different configurations of continuous fiber-reinforced hard composite portions and optionally hard composite portions that are not continuous fiber-reinforced.

In some embodiments, the continuous fibers described herein may be placed in a desired area or portion of the mold assembly 100 and reinforcing material 130 added around the placed continuous fibers. In some embodiments, the continuous fibers described herein may be formed into a specific shape for use in forming the continuous fiber-reinforced hard composite. For example, the continuous fibers may be spiral-shaped, a mesh, or an oriented wool and placed around the legs 142 and 144, which, as described in FIG. 1, may be oriented to mitigate crack propagation up flow passageways 42 and 44 in the direction of arrows A and B, respectively. In another example, the continuous fibers may be in the form of a wool with sufficient interstitial spacing to allow for reinforcing particles to flow into the wool. In some instances, the wool may be fabricated with a density that is too high to allow reinforcing particles to migrate into the voids defined in the wool. As such, in some instances, the wool may be mechanically expanded (e.g., pulled apart) to increase the voids or void spaces of the wool and thereby facilitate ingress of the reinforcing particles therein. As described further herein, combinations of the foregoing continuous fibers may be used to achieve a continuous fiber-reinforced bit body having different configurations of continuous fiber-reinforced hard composite portions and optionally hard composite portions that are not continuous fiber-reinforced.

In some embodiments, vibration may be used to increase the packing efficiency of the reinforcing material 130. In some instances during vibration, individual continuous fibers may move towards an orientation parallel to the ground (e.g., horizontal). This orientation may be useful in mitigating crack propagation in a generally perpendicular direction (e.g., as described relative to flow passageway 42 in the direction of arrow A).

After a sufficient volume of reinforcing material 130 has been added to the mold assembly 100, the metal blank 36 may then be placed within the mold assembly 100. The metal blank 36 preferably includes inside diameter 37, which is larger than the outside diameter 154 of sand core 150. Various fixtures (not expressly shown) may be used to position the metal blank 36 within the mold assembly 100 at a desired location. Then, the reinforcing material 130 may be filled to a desired level within the cavity 104.

As illustrated, binder material 160 may be placed on top of the reinforcing material 130, metal blank 36, and core 150. Alternatively, in some embodiments, the binder material 160 may be included with at least a portion of the reinforcing material 130. In some embodiments, the binder material 160 may be covered with a flux layer (not expressly shown). Alternatively, a binder material bowl (not expressly shown) disposed at the top of the funnel 120 may be used to contain the binder material 160, which, during infiltration, will then flow down into the reinforcing material 130.

A cover or lid (not expressly shown) may be placed over the mold assembly 100. The mold assembly 100 and materials disposed therein may then be preheated and then placed in a furnace. When the furnace temperature reaches or optionally exceeds the melting point of the binder material 160, the binder material 160 may liquefy and infiltrate the reinforcing material 130.

After a predetermined amount of time allotted for the liquefied binder material 160 to infiltrate the reinforcing material 130, the mold assembly 100 may then be removed from the furnace and cooled at a controlled rate. Once cooled, the mold assembly 100 may be broken away to expose the matrix bit body having a continuous fiber-reinforced hard composite portion. Subsequent processing and machining, according to well-known techniques, may be used to produce a matrix drill bit having the matrix bit body.

In some embodiments, the continuous fiber-reinforced hard composite portion may be homogeneous throughout the matrix bit body as illustrated in FIGS. 1-2.

In some embodiments, the continuous fiber-reinforced hard composite portion may be localized within a portion of the matrix bit body with the remaining portion being formed by a hard composite that is not continuous fiber-reinforced (e.g., including binder material and reinforcing particles and not including continuous fibers). In some instances, localization may provide mitigation for crack initiation and propagation while minimizing the additional cost that may be associated with some continuous fibers. Further, the inclusion of continuous fibers in the bit body may, in some instances, reduce erosion properties of the bit body because of the lower concentration of reinforcing particles. Therefore, in some instances, localization of the continuous fibers to only a portion of the matrix bit body may mitigate any reduction in erosion properties associated with the use of fibers.

Figure 5:
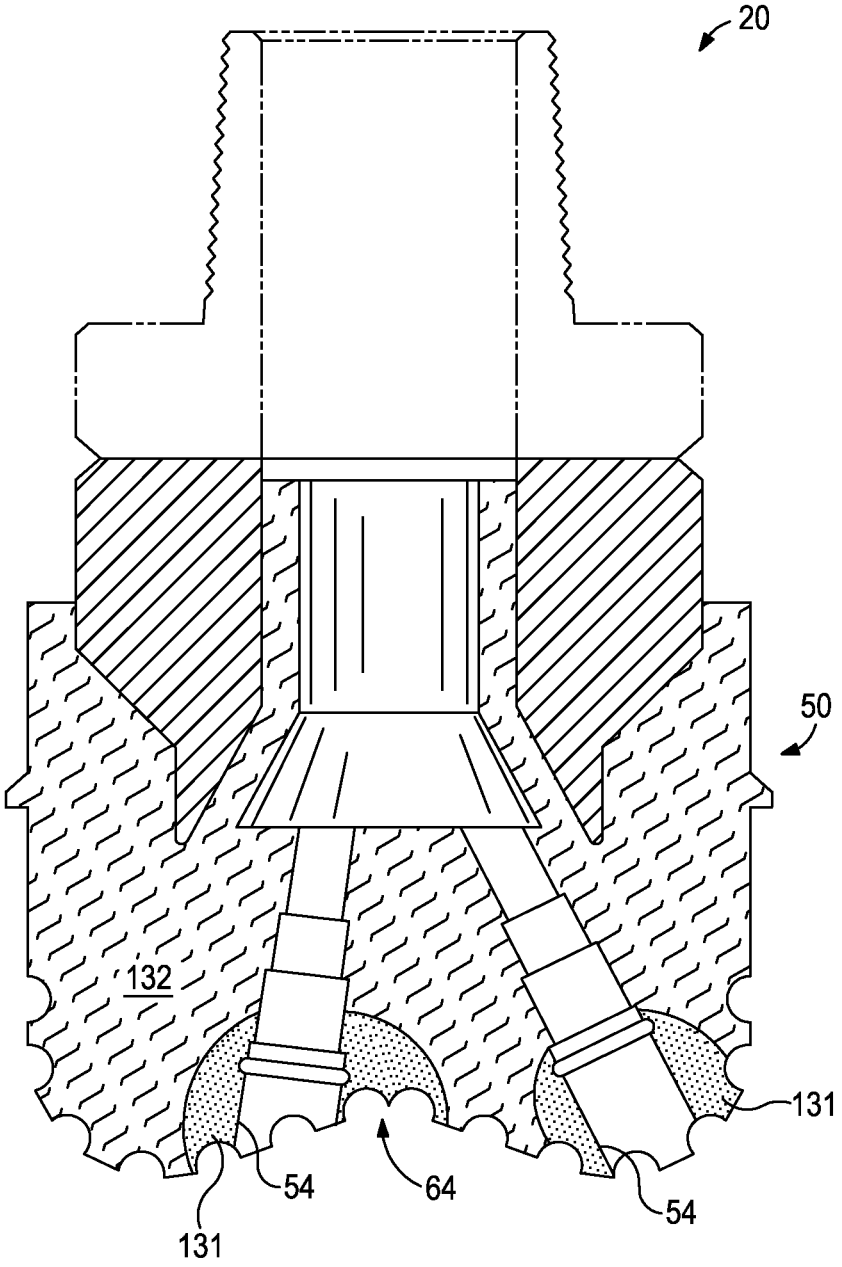
FIG. 5 is a cross-sectional view showing one example of a matrix drill bit in accordance with the teachings of the present disclosure.

For example, FIG. 5 is a cross-sectional view showing one example of a matrix drill bit 20 formed with a matrix bit body 50 having a hard composite portion that is not continuous fiber-reinforced 132 and one or more continuous fiber-reinforced hard composite portions 131 (two shown) in accordance with the teachings of the present disclosure. The continuous fiber-reinforced hard composite portions 131 are shown to be located proximal to the nozzle openings 54 and an apex 64, two areas of matrix bit bodies that typically have an increased propensity for cracking. As used herein, the term "apex" refers to the central portion of the exterior surface of the matrix bit body that engages the formation during drilling. Typically, the apex of a matrix drill bit is located at or proximal to where the blades 52 (FIG. 2) meet on the exterior surface of the matrix bit body that engages the formation during drilling.

In some embodiments, the continuous fiber-reinforced hard composite portion 131 may be formed from a reinforcing material that includes reinforcing particles and loose continuous fibers. In some embodiments, the continuous fiber-reinforced hard composite portion 131 may be formed by placing a wool of continuous fibers near the legs 142 and 144 of FIG. 4 and the apex portion of the mold assembly 100 of FIG. 4. In some embodiments, a combination of the foregoing may be implemented by placing the wool or other shaped continuous fibers in the mold assembly 100 of FIG. 4, and then adding the reinforcing material that includes loose continuous fibers within the mold assembly 100 of FIG. 4 proximal to the wool or other shaped continuous fibers.

Figure 6:
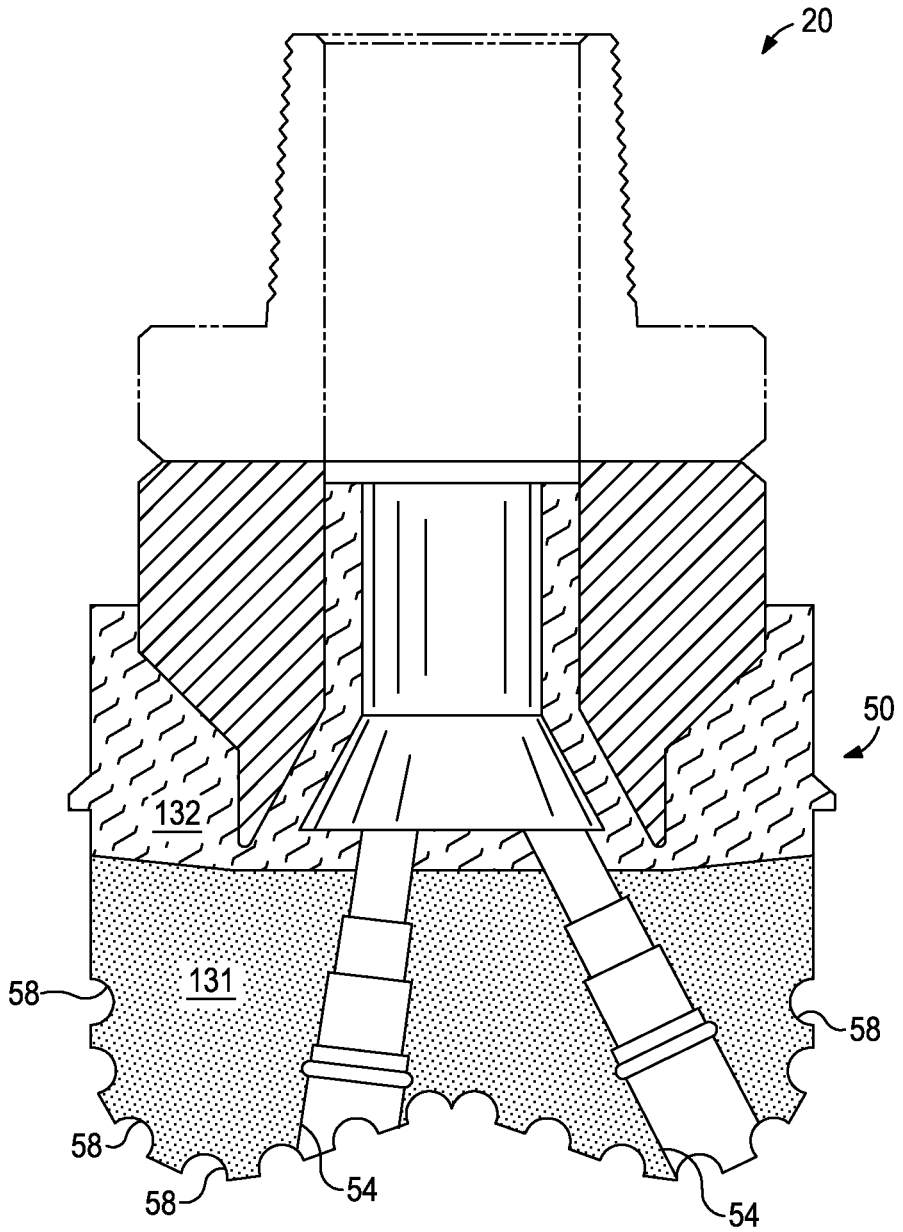
FIG. 6 is a cross-sectional view showing one example of a matrix drill bit in accordance with the teachings of the present disclosure.

In another example, FIG. 6 is a cross-sectional view showing one example of a matrix drill bit 20 formed with a matrix bit body 50 having a hard composite portion that is not continuous fiber-reinforced 132 and a continuous fiber-reinforced hard composite portion 131 in accordance with the teachings of the present disclosure. The continuous fiber-reinforced hard composite portion 131 is shown to be located proximal to the nozzle openings 54 and the pockets 58. Similar to FIG. 5, the continuous fiber-reinforced hard composite portion 131 may be formed from loose continuous fibers mixed with reinforcing particles, wool or other arranged continuous fibers, or a combination thereof.

In some embodiments, the continuous fibers may change in concentration, type of fibers, or both through the continuous fiber-reinforced hard composite portion 131. Similar to localization, changing the concentration, composition, or both of the continuous fibers may, in some instances, be used to mitigate crack initiation and propagation while minimizing the additional cost that may be associated with some continuous fibers. Additionally, changing the concentration, composition, or both of the continuous fibers within the matrix bit body 50 may be used to mitigate any reduction in erosion properties associated with the use of fibers.

Figure 7:
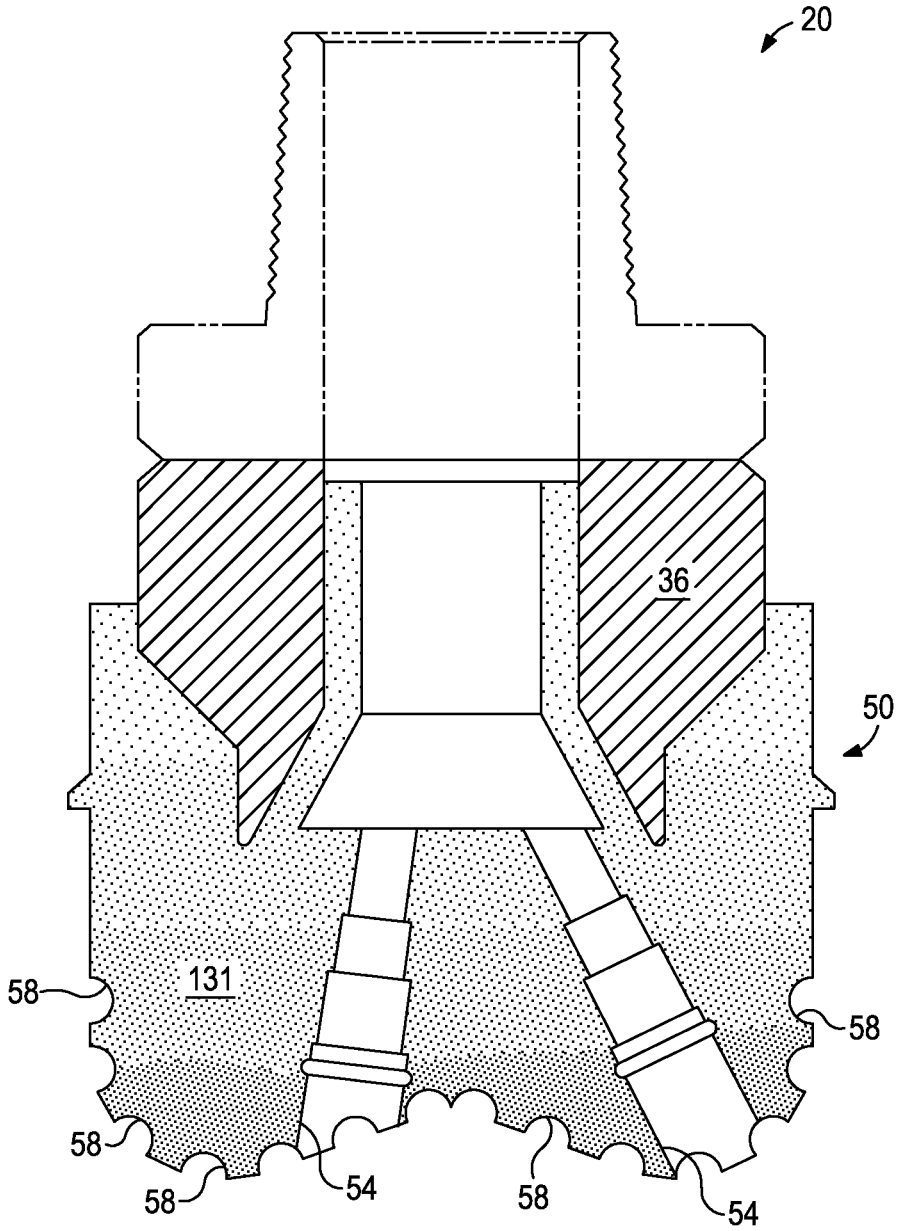
FIG. 7 is a cross-sectional view showing one example of a matrix drill bit in accordance with the teachings of the present disclosure.

For example, FIG. 7 is a cross-sectional view showing one example of a matrix drill bit 20 formed with a matrix bit body 50 having a continuous fiber-reinforced hard composite portion 131 in accordance with the teachings of the present disclosure. The concentration of the continuous fibers decreases or progressively decreases from apex to the shank of the matrix bit body 50 (as illustrated by the degree or concentration of stippling in the matrix bit body 50). As illustrated, the highest concentration of the continuous fiber-reinforced hard composite portion 131 is adjacent the nozzle openings 54 and the pockets 58 and the lower concentrations thereof are adjacent the metal blank 36.

Figure 8:
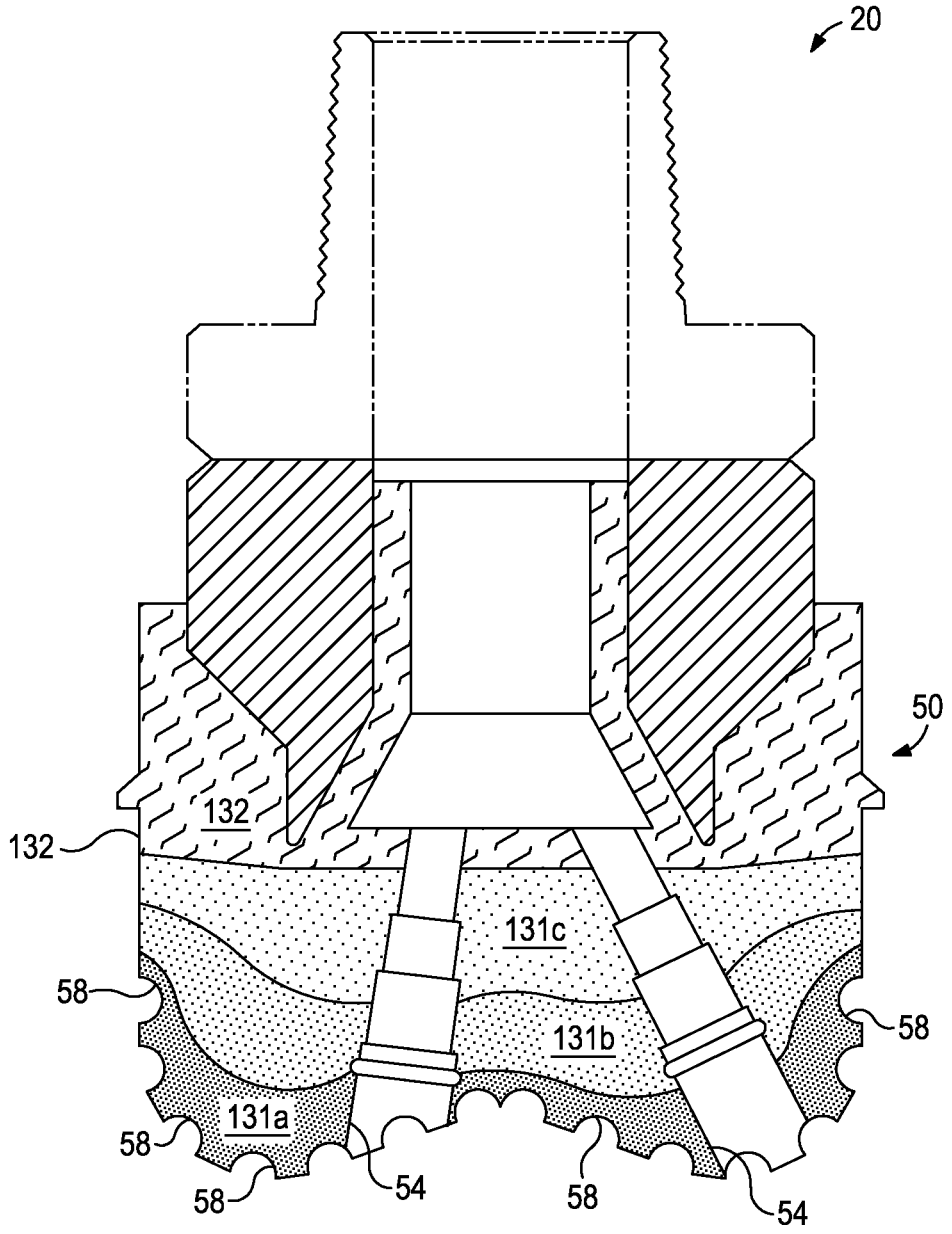
FIG. 8 is a cross-sectional view showing one example of a matrix drill bit in accordance with the teachings of the present disclosure.

In some instances, the concentration change of the continuous fibers in the continuous fiber-reinforced hard composite portion may be gradual. In some instances, the concentration change may be more distinct and resemble layering or localization. For example, FIG. 8 is a cross-sectional view showing one example of a matrix drill bit 20 formed with a matrix bit body 50 having a hard composite portion that is not continuous fiber-reinforced 132 and a continuous fiber-reinforced hard composite portion 131 in accordance with the teachings of the present disclosure. The continuous fiber-reinforced hard composite portion 131 is shown to be located proximal to the nozzle openings 54 and the pockets 58 in layers 131*a*, 131*b*, and 131*c*. The layer 131*a* with the highest concentration of continuous fibers is shown to be located proximal to the nozzle openings 54 and the pockets 58. The layer 131*c* with the lowest concentration of continuous fibers is shown to be located proximal to the hard composite portion that is not continuous fiber-reinforced 132. The layer 131*b* with the intermediate concentration of continuous fibers is shown to be disposed between layers 131*a* and 131*c*.

Alternatively, the continuous fiber-reinforced hard composite portion of layers 131*a*, 131*b*, and 131*c* may vary by the type of continuous fibers rather than, or in addition to, a concentration change.

One skilled in the art would recognize the various configurations and locations for the hard composite portions that are not continuous fiber-reinforced and the continuous fiber-reinforced hard composite portion (including with varying concentrations and/or compositions of the continuous fibers, which is sometimes referred to as functionally graded) that would be suitable for producing a matrix bit body, and a resultant matrix drill bit, that has a reduced propensity to have cracks initiate and propagate.

Further, one skilled in the art would recognize the modifications to the composition of the reinforcing material 130 of FIG. 4 to form a matrix bit body according to the above examples in FIGS. 5-8 and other configurations within the scope of the present disclosure.

Figure 9:
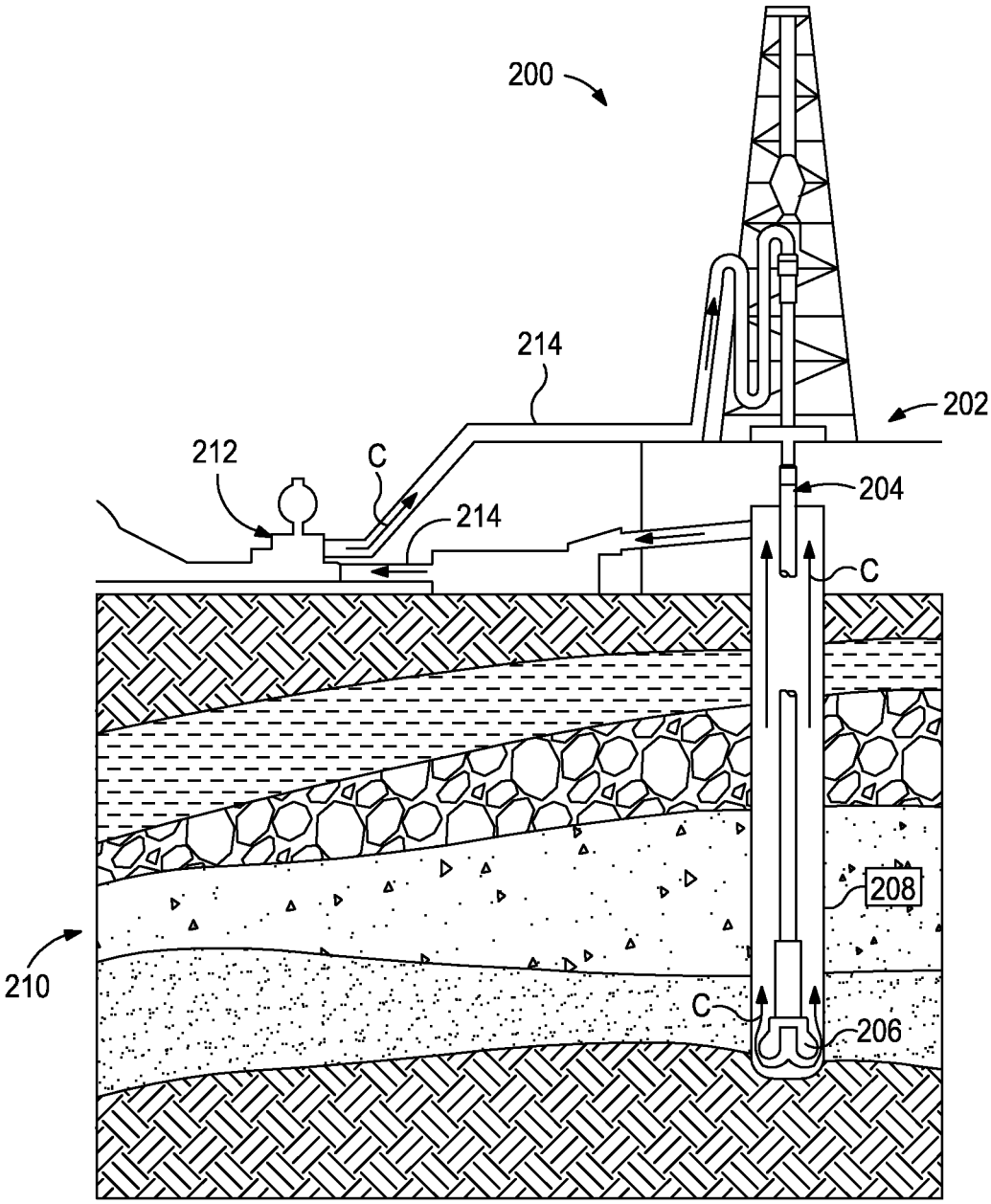
FIG. 9 is a schematic drawing showing one example of a drilling assembly suitable for use in conjunction with the matrix drill bits of the present disclosure.

FIG. 9 is a schematic showing one example of a drilling assembly 200 suitable for use in conjunction with the matrix drill bits of the present disclosure. It should be noted that while FIG. 9 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 200 includes a drilling platform 202 coupled to a drill string 204. The drill string 204 may include, but is not limited to, drill pipe and coiled tubing, as generally known to those skilled in the art. A matrix drill bit 206 according to the embodiments described herein is attached to the distal end of the drill string 204 and is driven either by a downhole motor and/or via rotation of the drill string 204 from the well surface. As the drill bit 206 rotates, it creates a wellbore 208 that penetrates the subterranean formation 210. The drilling assembly 200 also includes a pump 212 that circulates a drilling fluid through the drill string (as illustrated as flow arrows C) and other pipes 214.

One skilled in the art would recognize the other equipment suitable for use in conjunction with drilling assembly 200, which may include, but is not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like.

In some embodiments, the continuous fiber-reinforced hard composite described herein may be implemented in other wellbore tools or portions thereof and systems relating thereto. Examples of wellbore tools where a continuous fiber-reinforced hard composite described herein may be implemented in at least a portion thereof may include, but are not limited to, reamers, coring bits, rotary cone drill bits, centralizers, pads used in conjunction with formation evaluation (e.g., in conjunction with logging tools), packers, and the like. In some instances, portions of wellbore tools where a continuous fiber-reinforced hard composite described herein may be implemented may include, but are not limited to, wear pads, inlay segments, cutters, fluid ports (e.g., the nozzle openings described herein), convergence points within the wellbore tool (e.g., the apex described herein), and the like, and any combination thereof.

Some embodiments may involve implementing a matrix drill bit described herein in a drilling operation. For example, some embodiments may further involve drilling a portion of a wellbore with a matrix drill bit.

Embodiments disclosed herein include Embodiment A, Embodiment B, and Embodiment C.

Embodiment A

A wellbore tool formed at least in part by a continuous fiber-reinforced hard composite portion that includes a binder material continuous phase with reinforcing particles and continuous fibers contained therein, wherein the continuous fibers have an aspect ratio at least 15 times greater than a critical aspect ratio ($A_c$), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material.

Embodiment B

A drill bit that includes a matrix bit body; and a plurality of cutting elements coupled to an exterior portion of the matrix bit body, wherein the matrix bit body has a continuous fiber-reinforced hard composite portion that includes a binder material continuous phase with reinforcing particles and continuous fibers contained therein, wherein the continuous fibers have an aspect ratio at least 15 times greater than a critical aspect ratio (k), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material, wherein at least some of the continuous fibers have a diameter of 1 micron to 3 mm, and wherein at least some of the reinforcing particles have a diameter of 1 micron to 3000 microns.

Embodiment C

A drilling assembly that includes a drill string extendable from a drilling platform and into a wellbore; a drill bit attached to an end of the drill string and including a matrix bit body and a plurality of cutting elements coupled to an exterior portion of the matrix bit body, wherein the matrix bit body has a continuous fiber-reinforced hard composite portion that includes a binder material continuous phase with reinforcing particles and continuous fibers contained therein, and wherein the continuous fibers have an aspect ratio at least 15 times greater than a critical aspect ratio (k), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material; and a pump fluidly connected to the drill string and configured to circulate a drilling fluid to the drill bit and through the wellbore.

Exemplary additional elements may include the following in any suitable combination: Element 1: wherein at least some of the continuous fibers are arranged as an oriented wool; Element 2: wherein at least some of the continuous fibers are arranged as a disoriented wool; Element 3: wherein the wellbore tool is a drill bit comprising: a matrix bit body that includes the continuous fiber-reinforced hard composite portion; and a plurality of cutting elements coupled to an exterior portion of the matrix bit body; Element 4: Element 3 wherein the matrix bit body further includes a hard composite portion including the binder material and the reinforcing particles but omitting the continuous fibers; Element 5: Element 4 wherein the wellbore tool further includes a fluid cavity defined within the matrix bit body; at least one fluid flow passageway extending from the fluid cavity to the exterior portion of the matrix bit body; and at least one nozzle opening defined at an end of the at least one fluid flow passageway proximal to the exterior portion of the matrix bit body, wherein the continuous fiber-reinforced hard composite portion is located proximal to the at least one nozzle opening; Element 6: Element 5 wherein the wellbore tool further includes a plurality of cutter blades formed on the exterior portion of the matrix bit body; and a plurality of pockets formed in the plurality of cutter blades, wherein the continuous fiber-reinforced hard composite portion is located proximal to the at least one nozzle opening and the plurality of pockets; Element 7: Element 4 wherein the continuous fiber-reinforced hard composite portion is located at an apex of the matrix bit body; Element 8: Element 7 wherein the continuous fibers are arranged in an oriented wool; Element 9: wherein at least some of the continuous fibers have an aspect ratio of 25 or greater; Element 10: wherein at least some of the continuous fibers have a diameter of 1 micron to 3 mm; Element 11: wherein at least some of the continuous fibers have a composition that includes at least one selected from the group consisting of tungsten, molybdenum, niobium, tantalum, rhenium, titanium, chromium, steels, stainless steels, austenitic steels, ferritic steels, martensitic steels, precipitation-hardening steels, duplex stainless steels, iron alloys, nickel alloys, chromium alloys, carbon, refractory ceramic, silicon carbide, silicon nitride, silica, alumina, titania, mullite, zirconia, boron nitride, titanium carbide, titanium nitride, boron nitride, and any combination thereof; Element 12: wherein at least some of the reinforcing particles have a diameter of 1 micron to 3000 microns; and Element 13: wherein the wellbore tool is one of: a reamer, a coring bit, a rotary cone drill bit, a centralizer, a pad, or a packer.

By way of non-limiting example, exemplary combinations applicable to Embodiment A include: Element 1 in combination with Element 2; at least one of Elements 9-12 in combination with Element 1, Element 2, or both; at least two of Elements 9-12 in combination; one of Elements 3, 4, 5, 6, 7, 8, or 13 in combination with any of the foregoing; Element 5 in combination with Element 1; Element 5 in combination with Element 7; and so on.

By way of non-limiting example, exemplary combinations applicable to Embodiments B and C include: Element 1 in combination with Element 2; at least one of Elements 9-12 in combination with Element 1, Element 2, or both; at least two of Elements 9-12 in combination; one of Elements 3, 4, 5, 6, 7, or 8 in combination with any of the foregoing; Element 5 in combination with Element 1; Element 5 in combination with Element 7; and so on.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from a to b," "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A wellbore tool formed at least in part by a continuous fiber-reinforced hard composite portion that includes a binder material continuous phase with reinforcing particles and continuous fibers contained therein, wherein the continuous fibers have an aspect ratio of at least fifteen times greater than a critical aspect ratio ($A_c$), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material, wherein at least some of the continuous fibers are arranged as an oriented wool with an interstitial spacing to allow migration of the reinforcing particles, wherein the oriented wool is an entangled mass of continuous fibers where at least 90% of the continuous fibers in the entangled mass are oriented within 25° of each other.

2. The wellbore tool of claim 1, wherein others of the continuous fibers are arranged as a disoriented wool.

3. The wellbore tool of claim 1, wherein the wellbore tool is a drill bit comprising:

a matrix bit body that includes the continuous fiber-reinforced hard composite portion; and a plurality of cutting elements coupled to an exterior portion of the matrix bit body.

4. The wellbore tool of claim 3, wherein the matrix bit body further includes a hard composite portion including the binder material and the reinforcing particles but omitting the continuous fibers.

5. The wellbore tool of claim 4 further comprising:
a fluid cavity defined within the matrix bit body;
at least one fluid flow passageway extending from the fluid cavity to the exterior portion of the matrix bit body; and
at least one nozzle opening defined at an end of the at least one fluid flow passageway proximal to the exterior portion of the matrix bit body, wherein the continuous fiber-reinforced hard composite portion is located proximal to the at least one nozzle opening.

6. The wellbore tool of claim 5 further comprising:
a plurality of cutter blades formed on the exterior portion of the matrix bit body; and
a plurality of pockets formed in the plurality of cutter blades, wherein the continuous fiber-reinforced hard composite portion is located proximal to the at least one nozzle opening and the plurality of pockets.

7. The wellbore tool of claim 4, wherein the continuous fiber-reinforced hard composite portion is located at an apex of the matrix bit body.

8. The wellbore tool of claim 7, wherein the continuous fibers are arranged in an oriented wool.

9. The wellbore tool of claim 1, wherein at least some of the continuous fibers have an aspect ratio of 25 or greater.

10. The wellbore tool of claim 1, wherein at least some of the continuous fibers have a diameter of 1 micron to 3 mm.

11. The wellbore tool of claim 1, wherein at least some of the continuous fibers have a composition that includes at least one selected from the group consisting of tungsten, molybdenum, niobium, tantalum, rhenium, titanium, chromium, steels, stainless steels, austenitic steels, ferritic steels, martensitic steels, precipitation-hardening steels, duplex stainless steels, iron alloys, nickel alloys, chromium alloys, carbon, refractory ceramic, silicon carbide, silicon nitride, silica, alumina, titania, mullite, zirconia, boron nitride, titanium carbide, titanium nitride, boron nitride, and any combination thereof.

12. The wellbore tool of claim 1, wherein at least some of the reinforcing particles have a diameter of 1 micron to 3000 microns.

13. The wellbore tool of claim 1, wherein the wellbore tool is one of: a reamer, a coring bit, a rotary cone drill bit, a centralizer, a pad, or a packer.

14. A drill bit comprising:
a matrix bit body; and
a plurality of cutting elements coupled to an exterior portion of the matrix bit body,
wherein the matrix bit body has a continuous fiber-reinforced hard composite portion that includes a binder material continuous phase with reinforcing particles and continuous fibers contained therein, wherein the continuous fibers have an aspect ratio at least 15 times greater than a critical aspect ratio ($A_c$), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material, wherein at least some of the continuous fibers are arranged as an oriented wool with an interstitial spacing to allow migration of the reinforcing particles, wherein the oriented wool is an entangled mass of continuous fibers where at least 90% of the continuous fibers in the entangled mass are oriented within 25° of each other,
wherein at least some of the continuous fibers have a diameter of 1 micron to 3 mm, and
wherein at least some of the reinforcing particles have a diameter of 1 micron to 3000 microns.

15. The drill bit of claim 14, wherein the matrix bit body further includes a hard composite portion including the binder material and the reinforcing particles but omitting the continuous fibers.

16. The drill bit of claim 15 further comprising:
a fluid cavity defined within the matrix bit body;
at least one fluid flow passageway extending from the fluid cavity to the exterior portion of the matrix bit body; and
at least one nozzle opening defined by an end of the at least one fluid flow passageway proximal to the exterior portion of the matrix bit body, wherein the continuous fiber-reinforced hard composite portion is located proximal to the at least one nozzle opening.

17. The drill bit of claim 16 further comprising:
a plurality of cutter blades formed on the exterior portion of the matrix bit body, the plurality of cutting elements being arranged on the plurality of cutter blades; and
a plurality of pockets formed in the plurality of cutter blades, wherein the continuous fiber-reinforced hard composite portion is located proximal to the at least one nozzle opening and the plurality of pockets.

18. A drilling assembly comprising:
a drill string extendable from a drilling platform and into a wellbore;
a drill bit attached to an end of the drill string and including a matrix bit body and a plurality of cutting elements coupled to an exterior portion of the matrix bit body, wherein the matrix bit body has a continuous fiber-reinforced hard composite portion that includes a binder material continuous phase with reinforcing particles and continuous fibers contained therein, and wherein the continuous fibers have an aspect ratio at least 15 times greater than a critical aspect ratio ($A_c$), wherein $A_c=\sigma_f/(2\tau_c)$, $\sigma_f$ is an ultimate tensile strength of the continuous fibers, and $\tau_c$ is a lower of (1) an interfacial shear bond strength between the continuous fibers and the binder material and (2) a yield stress of the binder material, wherein at least some of the continuous fibers are arranged as an oriented wool with an interstitial spacing to allow migration of the reinforcing particles, wherein the oriented wool is an entangled mass of continuous fibers where at least 90% of the continuous fibers in the entangled mass are oriented within 25° of each other; and
a pump fluidly connected to the drill string and configured to circulate a drilling fluid to the drill bit and through the wellbore.

* * * * *